United States Patent [19]

Bertozzi

[11] Patent Number: 4,630,820

[45] Date of Patent: Dec. 23, 1986

[54] PLASTIC COATED BOWLING PIN

[76] Inventor: Albert Bertozzi, 9 Harding Ave., East Providence, R.I.

[21] Appl. No.: 678,273

[22] Filed: Dec. 5, 1984

[51] Int. Cl.[4] ..... A63D 9/00

[52] U.S. Cl. ..... 273/82 R; 273/82 B; 273/DIG. 4; 264/275

[58] Field of Search ..... 273/82 R, 82 B, 82 A

[56] References Cited

U.S. PATENT DOCUMENTS

| | | | |
|---|---|---|---|
| 1,088,312 | 2/1914 | Whelan | 273/82 R |
| 2,166,950 | 7/1939 | German et al. | 273/82 R |
| 2,246,411 | 6/1941 | Kraft | 273/82 R |
| 2,400,089 | 5/1946 | Henley | 273/82 R |
| 2,775,456 | 12/1956 | Schroeder et al. | 273/82 R |
| 3,141,672 | 7/1964 | Unterbrink | 273/82 R |
| 3,169,020 | 2/1965 | Smith | 273/82 B |
| 3,231,274 | 1/1966 | Wanders | 273/82 R |
| 3,241,835 | 3/1966 | Satchell et al. | 273/82 A |

*Primary Examiner*—Richard C. Pinkham
*Assistant Examiner*—Matthew L. Schneider
*Attorney, Agent, or Firm*—Barlow & Barlow, Ltd.

[57] ABSTRACT

A bowling pin having a wooden core and a polyethylene plastic covering. The belly portion of the wooden core is circumferentially recessed so that the plastic covering is thicker in that section than the rest of the pin. A ledge is formed on the wooden core above the recess and a collar is formed on the wooden core below the recess so as to aid in securely positioning the plastic cover over the wooden core. The core is also provided with sound chambers and a recess in the base for receiving a base plug.

1 Claim, 12 Drawing Figures

PLASTIC COATED BOWLING PIN

STATEMENT OF INVENTION

The present invention relates to bowling pins and more particularly to a bowling pin having a wooden core with a molded plastic outer covering; said covering relieving said core of the action of bowling ball shock and function of restitution.

BACKGROUND OF INVENTION

The present invention is an improvement over the following U.S. Pat. Nos. 3,044,777 dated July 17, 1962; 3,329,430 dated July 4, 1967; 3,201,124 dated Aug. 17, 1965; 1,053,957 dated Feb. 18, 1913; 3,155,753 dated Nov. 3, 1964; 3,044,777 dated July 17, 1962 and 3,193,291 dated July 6, 1965.

Bowling pins now in common use are either made of maple wood, or of maple wood coated with a thin uniform coating of thermo-plastic material. The deficiencies of the all-wooden pins and the uniformly plastic-coated wooden pins are well known by informed people in the trade.

In the first place, the wood from which both types of pins are made is a natural forest product with many random variations in grain strength, depending on the conditions of climate and rainfall affecting growth.

In the second place, as a direct result of the foregoing, both types of pins have a relatively short useful life. Cracking along the grain, in the case of the all-wooden pin or delamination of the plastic coating, in the case of the plastic-coated pin.

In the third place, the entire problem is now seriously aggravated by a shortage of the proper maple wood used in bowling pins.

The logical answer to this problem is a completely synthetic pin, a pin constructed completely of synthetic material, such as plastic of a proper design. But this alone is not enough. In order for the all-plastic pin to be accepted by the trade, two additional attributes must be provided. The first of these is proper action or scorability. This function incorporates the physical characteristics of weight, outside dimensions, balance around a vertical axis, center of gravity, radius of gyration, moment of inertia and coefficient of restitution. The second attribute is that of sound.

The history and tradition of the game of bowling requires that there be no sudden changes in scoring conditions. Past records are constantly compared with present results, and it is essential that no fundamental changes occur that would alter these comparisons. This problem when analyzed and reduced to its essence can be stated in this way: (1) a similar percentage of strikes should occur with a ball thrown in the pocket of a set of pins; and (2) a similar set of pins "leaves" should be expected from a ball which does not strike full in the pocket; and (3) unless the sound is close in character and quality to the wooden pins, the patron will be slow to accept it.

OBJECTS OF THE INVENTION

With the foregoing resume of the problem in mind, the objects of the present invention include:

First, to provide a bowling pin consisting of a wooden core with a plastic blanket or outer covering which duplicates closely the observable characteristics of a maple bowling pin when in good condition, more particularly, to exhibit a comparable action and scorability, and to produce a sound closely simulating the sound produced by maple bowling pin when struck by the bowling ball and by each other during pin action on the alley;

Second, to provide a bowling pin consisting of a wooden core with a plastic blanket outer covering which is capable of withstanding impacts of a bowling ball and impacts from other bowling pins without splitting, cracking, or chipping, and which, in fact, remains in virtually its initial condition after many thousands of lines, that is, long beyond the life of a maple bowling pin; is prolonged by repeated reconditioning and repair; thereby providing a bowling pin which, though having a higher initial cost than maple bowling pins, has instead such prolonged life that the net cost per line to the bowling alley operator is materially reduced;

Third, to provide a bowling pin consisting of a wooden core with a plastic blanket outer covering, thereby creating, a novelly constructed body member and bottom member of a different Shore hardness to provide optimum resilience in the region of ball-impact by the bowling ball, and optimum hardness and strength at the bottom of the bowling pin so that the stability of the bowling pin is not changed nor impaired with constant use;

Fourth, to provide a bowling pin consisting of a wooden core with a plastic blanket outer covering, thereby creating, a novel means of producing an essential musical note closely simulating the ring of a wooden pin in good condition;

Fifth, to provide a bowling pin consisting of a wooden core with a plastic blanket outer covering, wherein the center of gravity is located in the region corresponding to the center of gravity of a wooden pin, thereby to exhibit the proper action typical of good quality wooden pins.

Other objects of the present invention will be pointed out in part and become apparent in part in the following specifications and claims.

BRIEF DESCRIPTION OF THE DRAWINGS

Referring to the drawings in which similar characters of reference indicate corresponding parts in all the figures:

FIG. 6 is a vertical cross sectional view taken on line 6—6 of

FIG. 5;

In proceeding with the description of this invention, attention is directed to FIGS. 2 and 6 wherein the cores shown are identical in structure with the exception that FIG. 2 shows a solid maple wooden pin and FIG. 6 shows a laminated wooden pin. Both cores are subject to the same molding process, as will presently appear.

Figure 1:
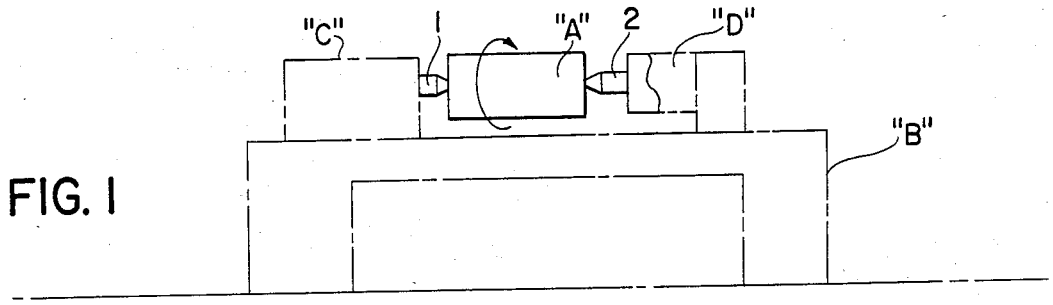
FIG. 1 is a diagrammic view of a lathe turning a blank into a desired shape.
Figure 4:
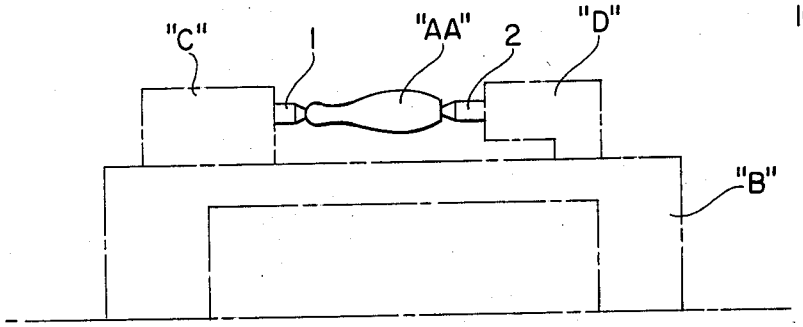
FIG. 4 is a view similar to FIG. 1 wherein the lathe is turning the molded pin into a finished product; or is used to remove a portion of the outer surface of a used pin.

Reference is now made to the drawngs and is initially addressed to FIGS. 1 and 4 wherein is shown (FIG. 1) a solid wooden block "A" or a laminated wooden block "A" or as shown in FIG. 4, a used bowling pin "AA". The block "A" or pin "AA" is held in a rotatable position in a diagrammic illustration of an engine lathe "B" provided with a head stock "C" having a left center 1 and a tail stock "D" having a right center 2. Centers 1 and 2 are provided with means to move toward and away from each other whereby the block "A" or pin AA is held in gripping and gripping release position. A turning tool (not shown) is manipulated against the rotating block or pin to produce the desired shape as the moldable core of a bowling pin.

Figure 2:
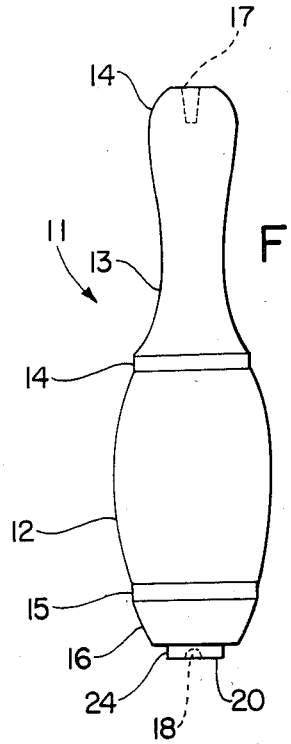
FIG. 2 is a wooden bowling pin turned into a desired shape.
Figure 6:
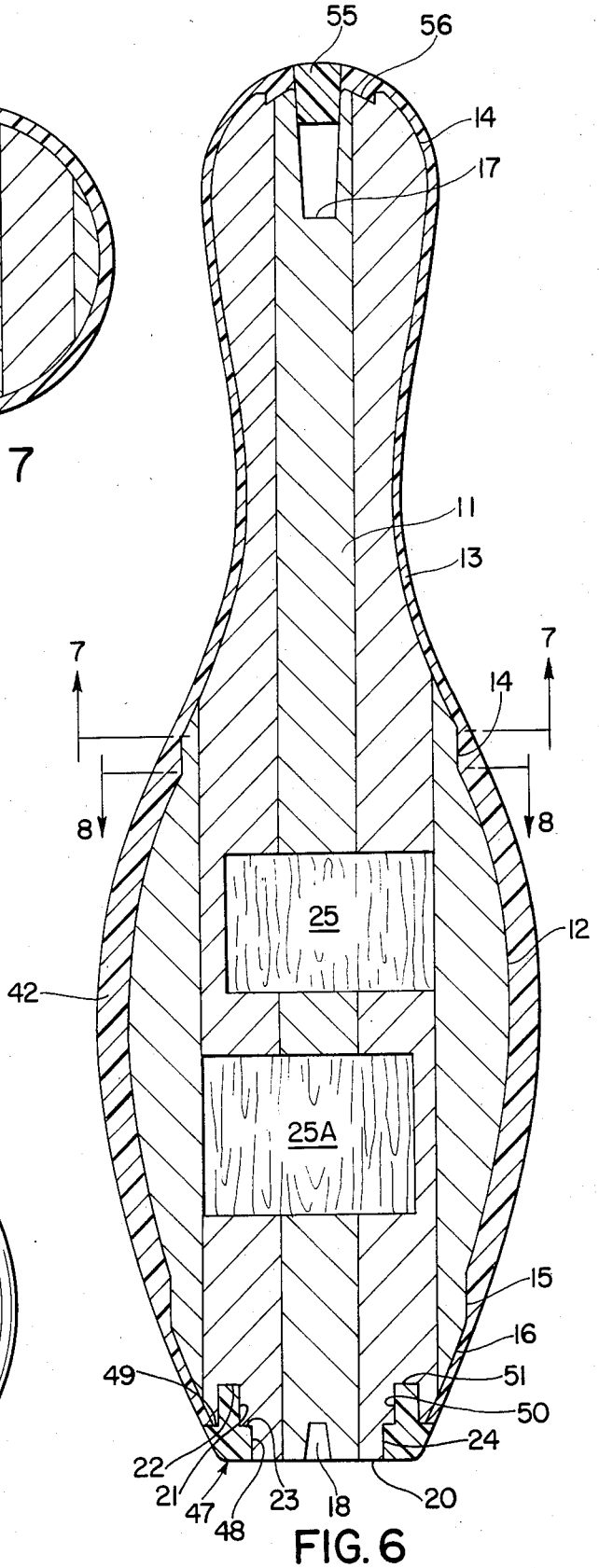
Figure 10:
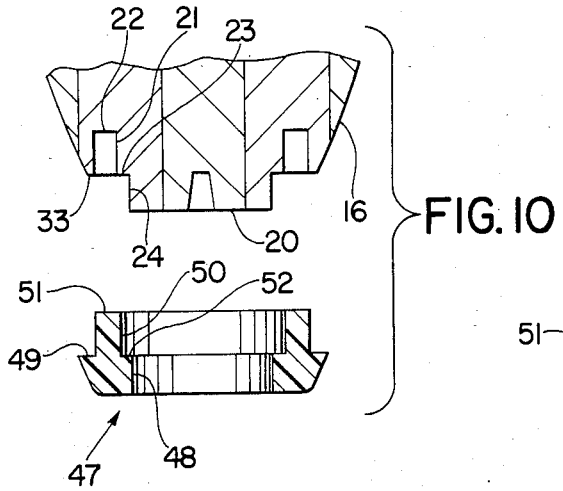
FIG. 10 is a fragmentary cross sectional view of the bottom end of the core without the base plug.

The shape produced by the lathe from block "A" or used pin "AA" is shown in FIGS. 2 and 6 and consists of a body member or core, generally indicated by reference numeral 11, contoured to define a circumferential recessed belly 12, neck 13, head 14 and bottom section 16 of a bowling pin. The core 11 is provided with a circumferial recess belly 12 which creates a first ledge 14 between the belly 12 and neck 13 and a collar 15 between belly 12 and bottom section 16. Essentially, both the ledge 14 and a collar 15 are circumferential bands whose surface is substantially parallel to the axis of the pin defined between recesses 17 and 18. Bottom 16 is tapered downward from collar 15 and is provided with a circular recess 21, a seat 22, a shoulder 23, a vertical wall 24 and a base 20.

Lathe centers 1 and 2 may provide medially aligned upper recess 17 and lower recess 18 or the block "A" or pin "AA" may be provided with recesses 17 and 18 as manufacturing means prior to the gripping action of the centers 1 and 2.

With reference to FIGS. 5, 6, 7 and 8, core 11 FIG. 6 is provided with sound chambers 25 and 25A at the time the several laminations are assembled to form block A. The sound chambers are formed to assist the pin in producing a musical note closely simulating the ring of a maple wooden pin in good condition and for weight adjustment.

Figure 3:
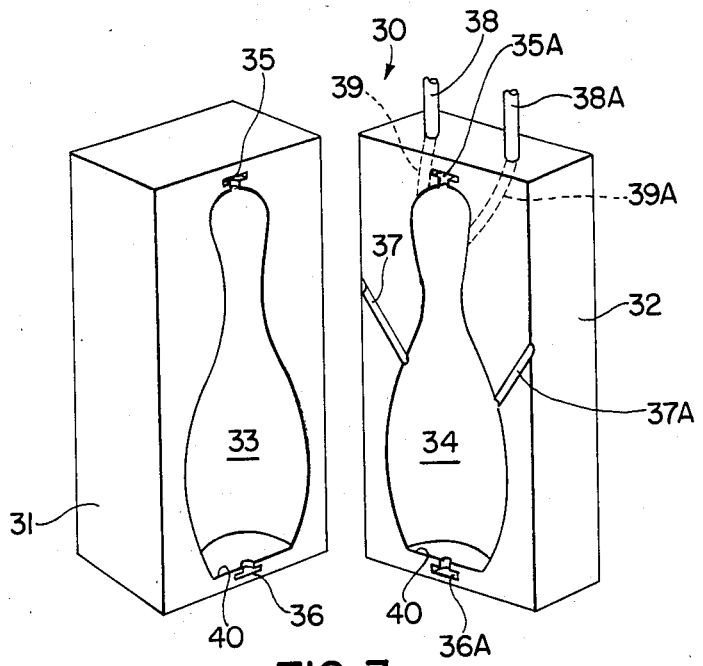
FIG. 3 is a schematic view of a mold.

FIG. 3 diagrammatically illustrates a two-part mold, generally indicated by reference numeral 30. The mold 30 comprises two half body parts 31 and 32; each of which is provided with a half cavity 33, 34 respectively. Each half cavity 33, 34 represents one-half of the completed molded product. Body part 31 is provided with an upper "T" slot 35 in communication with cavity 33. In like manner, an oppositely aligned upper "T" slot 35A is provided in body part 32 and in communication with cavity 34. A lower "T" slot 36 is provided in body part 31 in communication with cavity 33 and an oppositely aligned lower "T" slot 36A is provided in body part 32 and in communication with cavity 34. Spours 37, 37A located in body part 32 provide means for liquid plastic material to flow into both cavities when the body parts 31, 32 are pressed together to form a hollow cavity mold. Two fluid access pipes 38 and 38A are extensions of spours 39, 39A located in body member 32 an in communication with cavities 33, 34 when the two body parts engage to form a closed mold.

Core 11 is provided with two "T" pins 42, located respectively in upper recess 17 and lower recess 18. "T" pin 42 located in upper recess 17 engage "T" slots 35 and 35A and "T" pin 42 located in lower recess 18 engage "T" 36, 36A. In this manner core 11 is medially held in body members 31, 32 when mold 30 is closed in molding position.

Figure 11:
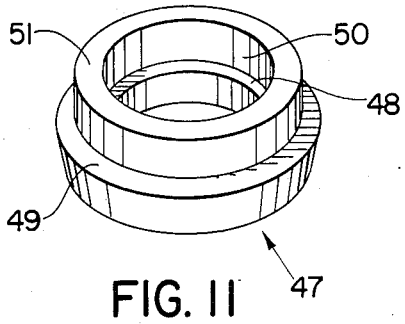
FIG. 11 is a perspective view of a base plug.
Figure 12:
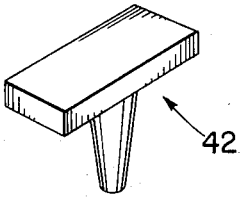
FIG. 12 is a perspective view of a "T" pin.

A base plug, generally indicated by reference numeral 47 (FIG. 11) provided with an axial passageway 48, a ledge 49, a flange 50 and a flange top 51. Base plug 47, prior to insertion of core 11 into mold 30, is attached to core 11 as follows: Flange 50 is inserted into circular recess 21 with flange top 51 abutting seat 22. Rim 52 abutts shoulder 23 and axial passageway 48 engaged vertical wall 24. Ledge 49 engaging shelf 33. In this manner base plug 47 is removably secured to bottom section 16.

Upper recess 17 may be provided with a plug 55 and a depression 56 in head 14, surrounding plug 55 so that in the molding process plastic material may fill the depression and fasten plug 55 in upper recess 17. In this manner a counterweight may be provided to the balance of the bowling pin.

Figure 9:
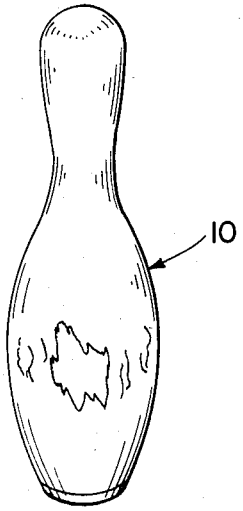
FIG. 9 is a view of a damaged bowling pin fabricated in accordance with the prior art.
Figure 5:
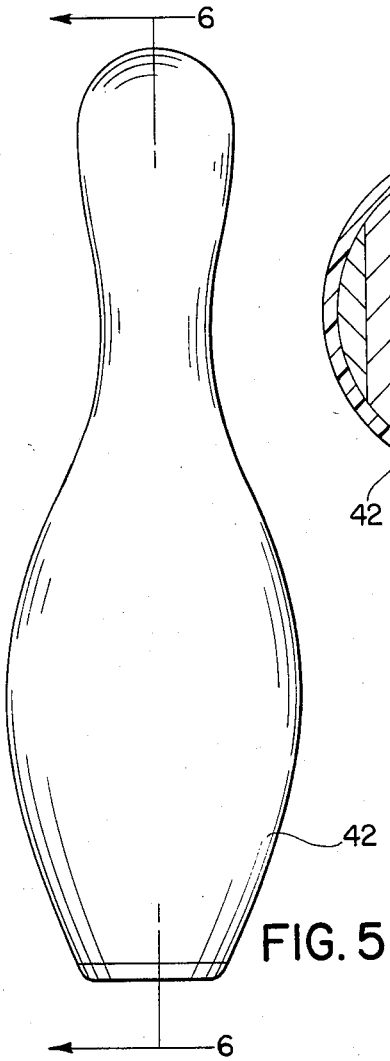
FIG. 5 is a view of a bowling pin produced by the enumerated method.
Figure 7:
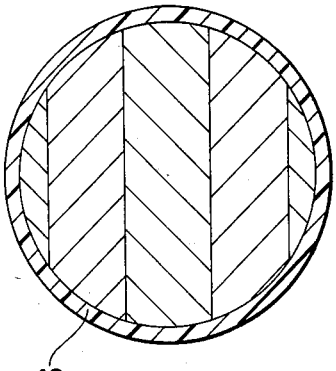
FIG. 7 is a horizontal sectional view looking in the direction of the arrows in FIG. 6.
Figure 8:
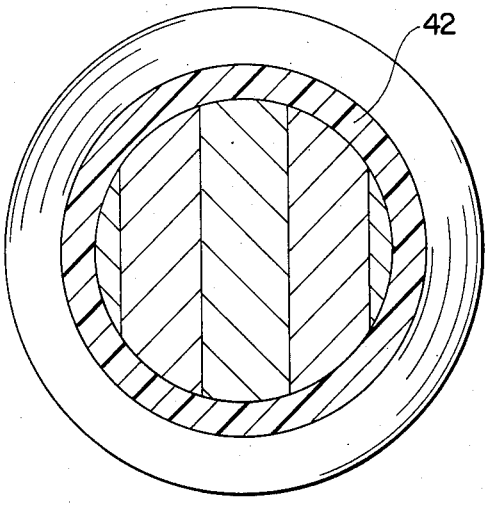
FIG. 8 is a view similar to FIG. 7 looking in the direction of the arrows pointing in the opposite direction of FIG. 7.

In practice, engine lathe "B" (FIGS. 1 and 4) will turn a wooden block "A" or a used bowling pin 10 (FIG. 9) into a core 11 (FIGS. 2 and 6). "T" pins 42 will be inserted in upper recess 17 and lower recess 18, respectively. Mold 30 will be positioned in open position. The core 11 will be inserted into cavity 33 in body part 31 with "T" pins 42 located in "T" slots 35 and 36. In this manner core 11 will medially be held in cavity 33 of body part 31. Body part 32 will be placed over core 11 with cavity 34 mating with cavity 33 and "T" pins 42 engaging "T" slots 35A, 36A, respectively, as the mold is closed into molding condition.

By way of example and not limitation, a high density, high molecular weight polyethelene in fluid state will be passed through access pipes 38, 38A and spours 39, 39A and spours 37, 37A into the cavity formed by half cavities 33, 34. In this manner core 11 will receive a coat of plastic material fastened to core 11 as it cools or returns to ambient temperature. Core 11 will have an outer contour the shape of the cavity formed by half cavities 31, 32.

The mold 30 will be separated into two parts, "T" pins will be removed from the mold as the core 11 is withdrawn from mold 30. The "T" pins will be withdrawn from the core leaving recesses 17 and 18 open. The coated core 11 will be placed in an engine lathe (FIG. 4) where the lathe tool will cut the plastic shape into a pre-selected bowling shape having a pre-determined thickness.

The plastic coat will be mechanically supported upon core 11 by being attached to ledge 14 and collar 15. As shown in FIG. 6, the plastic coat will terminate at second ledge 49. It will be observed that the plastic coat has a greater thickness surrounding the belly 12 of the core 11 between first ledge 14 and collar 15. In this manner the greater thickness, covering the strike zone, absorbs the ballistic force of the bowling pin and prevents the ballistic force from imparting itself to the wooden core 11. In this manner a composite bowling pin structure is provided leaving a wooden core with extended life over prior art plastic coated wooden bowling pins.

By way of example and not limitation, the high density, high molecular weight polyethelene is manufactured by American Hoechst Corporation and sold under the trade mark "HOSTALEN."

Having shown and described a preferred embodiment of the present invention, by way of example, it should be realized that structural changes could be made and other examples given without departing from either the spirit or scope of this invention.

What I claim is:

1. A composite bowling pin structure comprising a maple wooden core body member contoured to provide a head section at the top of said body, a neck section extending therefrom, a belly section extending from said neck station and a tapered bottom section at the bottom of said body; said belly section being circumferentially recessed and said bottom section having a base wherein said body further includes a ledge between said recess and neck and a collar between said recess and bottom section, said pin having a main axis extending along its length, said ledge and collar being defined by a circumferential band whose surface is substantially parallel to the main axis of the pin, the thickness of a portion of said recessed belly section in a direction perpendicular to said main axis being greater than the corresponding thickness of said ledge, said collar being located adjacent the base of the bottom section and having a sharp corner at the junction with the tapered bottom section, said bottom section base having a recessed means for receiving a plug and being tapered downward from said collar to the base, a plug, said plug removably secured in said recessed means, and an outer covering of molded plastic consisting of high density, high molecular weight polyethelene bonded to said core body member, with the thickness of said plastic being greater in said circumferential recessed belly than the thickness of said covering over the remainder of said core, whereby, said ledge and said collar structurally support said covering of molded plastic through the difference of thickness between the thickness of said plastic in said circumferential recessed belly and the thickness of said covering over the remainder of said core body member, thereby, to provide protection to said wooden core body member of bowling ball shock and function of restitution to said wooden core.

* * * * *